US011317190B2

(12) United States Patent
Stefansen

(10) Patent No.: US 11,317,190 B2
(45) Date of Patent: Apr. 26, 2022

(54) HEADSET WITH A DOUBLE-HINGED MICROPHONE ARM

(71) Applicant: GN Audio A/S, Ballerup (DK)

(72) Inventor: Mads Schenstrøm Stefansen, Ballerup (DK)

(73) Assignee: GN AUDIO A/S, Ballerup (DK)

( * ) Notice: Subject to any disclaimer, the term of this patent is extended or adjusted under 35 U.S.C. 154(b) by 0 days.

(21) Appl. No.: 17/210,112

(22) Filed: Mar. 23, 2021

(65) Prior Publication Data

US 2021/0306736 A1 Sep. 30, 2021

(30) Foreign Application Priority Data

Mar. 30, 2020 (DK) ..... PA202000362

(51) Int. Cl.

| | |
|---|---|
| ***H04R 25/00*** | (2006.01) |
| ***H04R 1/10*** | (2006.01) |
| ***H04R 1/08*** | (2006.01) |
| ***H04R 5/033*** | (2006.01) |

(52) U.S. Cl.

CPC ..... *H04R 1/1066* (2013.01); *H04R 1/083* (2013.01); *H04R 1/1008* (2013.01); *H04R 5/0335* (2013.01)

(58) Field of Classification Search

CPC .... H04R 1/1066; H04R 1/083; H04R 1/1008; H04R 5/0335

USPC ..... 381/355

See application file for complete search history.

(56) References Cited

U.S. PATENT DOCUMENTS

| | | | | |
|---|---|---|---|---|
| 4,987,592 | A | 1/1991 | Flagg | |
| 5,381,486 | A | 1/1995 | Ludeke et al. | |
| 6,768,804 | B1 * | 7/2004 | Isvan | H04R 1/083 381/372 |
| 2010/0040252 | A1 | 2/2010 | Thompson et al. | |
| 2015/0382101 | A1 * | 12/2015 | Dai | H04M 1/6058 381/375 |
| 2018/0352317 | A1 * | 12/2018 | Larsen | H04R 1/1008 |

OTHER PUBLICATIONS

The extended European search report issued in European Application No. 21163867.1, dated Aug. 11, 2021.

* cited by examiner

*Primary Examiner* — Phylesha Dabney

(74) *Attorney, Agent, or Firm* — Hamre, Schumann, Mueller & Larson, P.C.

(57) ABSTRACT

A headset comprising a first earphone and a microphone arm, which is rotatable around a first hinge axis, so it can rotate between a use position and a rest position. The microphone arm comprises a first arm part extending from the first hinge and a second arm part extending between the first arm part and a free end. The first arm part and the second arm part are interconnected by a second hinge. The second arm part comprises an engagement part, which during rotation of the microphone arm around the first axis from the use position to the rest position is adapted to engage the earphone, whereby the second arm part is forced to rotate from the second position to the first position.

10 Claims, 6 Drawing Sheets

HEADSET WITH A DOUBLE-HINGED MICROPHONE ARM

TECHNICAL FIELD

The invention relates to a headset comprising a first earphone with an inner side facing the user's head, when the headset is worn, and an outer side facing the opposite direction of the inner side, and a circumferential wall located between the inner side and the outer side, and wherein the headset comprises a microphone arm, which is attached to the earphone to be rotatable around a first hinge axis of a first hinge, so it can rotate between a use position, where it extends away from the earphone housing, and a rest position, where it follows a first part of the circumferential wall, wherein the first earphone has a recess for receiving the microphone arm in the rest position.

BACKGROUND ART

Headsets, headphones and earphones are used more and more by modern people at work and in spare time for telecommunication and listening to media content. Thus, more and more office workers spend time with unified communication over the Internet via f. ex. Skype®. To this purpose, headsets are used extensively. A headset is a head worn device comprising at least one speaker and a microphone in order to provide hands free telecommunication for a user wearing the headset. There exist many different types of headsets with different wearing styles, such as mono headsets with an ear hook and duo headsets with two earphones and a microphone arranged at the tip of a microphone arm. It has also become more and more common for people to listen to music while moving around in the society.

US 2010/0040252, FIG. 7 discloses a headset comprising a first earphone with an inner side facing the user's head, when the headset is worn, and an outer side facing the opposite direction of the inner side, and a circumferential wall located between the inner side and the outer side, and wherein the headset comprises a microphone arm, which is attached to the earphone to be rotatable around a first hinge axis of a first hinge, so it can rotate between a use position, where it extends away from the earphone housing, and a rest position, where it follows a first part of the circumferential wall.

The object of the invention is to provide a new and improved headset.

DISCLOSURE OF INVENTION

The headset according to the preliminary part is characterized in that the microphone arm comprises a first arm part extending from the first hinge and a second arm part extending between the first arm part and a free end, and wherein the first arm part and the second arm part are interconnected by a second hinge with a second hinge axis, whereby the first arm part, the second arm part and the second hinge are adapted, so that the free end of the microphone arm can be brought closer to the mouth of the user by rotating the second arm part about the second hinge axis from a first position to a second position, and wherein the second arm part comprises an engagement part, which during rotation of the microphone arm around the first axis from the use position to the rest position is adapted to engage the earphone, whereby the second arm part is forced to rotate from the second position to the first position. With this solution, the user can simply push the first arm part in the direction of the recess to put the microphone arm into the rest position without having to first rotate the second arm part from the second position to the first position. The second arm part automatically move into the first position, so the complete microphone arm will come into the rest position.

According to an embodiment, the engagement part is adapted to engage an edge part of the recess during rotation of the microphone arm from the use position to the rest position.

According to an embodiment, the engagement part is embodied as a protrusion in the vicinity of the second hinge.

According to an embodiment, the engagement part is provided by a first side face part of the first side face.

According to an embodiment, the microphone arm is curved. This curvature can be utilized to bring the free end of the microphone arm closer to the user's mouth.

According to an embodiment, the second arm part has an outer surface with a curvature corresponding to a curvature of the first part of the circumferential wall. Thus, the outer side of the microphone can flush with the circumferential wall, making the appearance more aesthetic in the rest position.

According to an embodiment, the inner side of the first earphone has an essentially oval shape.

According to an embodiment, the inner side of the first earphone has an essentially round shape.

According to an embodiment, the second arm part is made of a non-bendable structure. Thus, the user may not be able to bend the microphone into a non-optimal position.

According to an embodiment, the second arm part is longer than the first arm part.

According to an embodiment, the second arm part is at least two times, preferably at least three times as long as the first arm part.

According to an embodiment, the first hinge is located at the lower end of the earphone, wherein the lower end is defined as the end closest to the user's mouth when the headset is worn.

According to an embodiment, the first hinge and the second hinge are mechanically interconnected, so that a rotation of about the first hinge axis causes a rotation about the second hinge axis. Thus, an optimal positioning of the microphone arm can be ensured.

According to an embodiment, the second hinge axis is essentially perpendicular to the first hinge axis.

According to an embodiment, the second hinge axis is angled 30-60 degrees in relation to first hinge axis.

According to an embodiment, the free end of the microphone arm is moved at least 2 cm, 3 cm or 4 cm in the direction of the first hinge axis towards the users mouth, when the microphone arm is moved from the rest position to the use position.

BRIEF DESCRIPTION OF THE DRAWINGS

The invention is explained in detail below with reference to the drawing illustrating preferred embodiments of the invention and in which.

MODES FOR CARRYING OUT THE INVENTION

Figure 1:
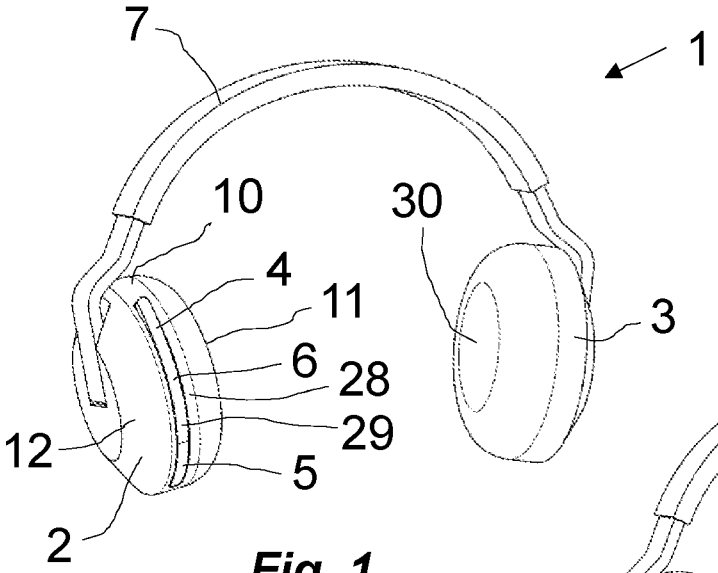
FIG. 1 is a headset according to a first embodiment of the invention with a microphone arm in a rest position.
Figure 2:
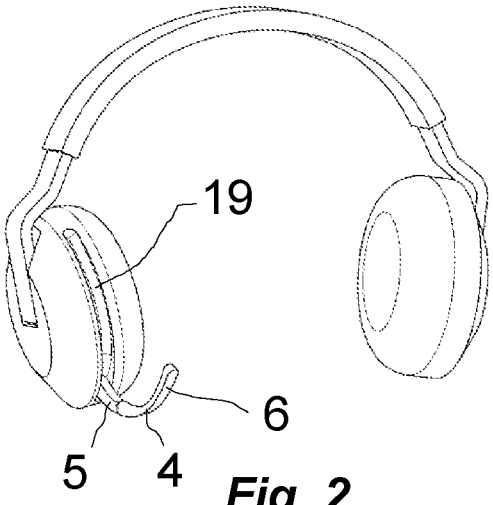
FIG. 2 is a perspective view of the headset with the microphone arm in an intermediate position.
Figure 3:
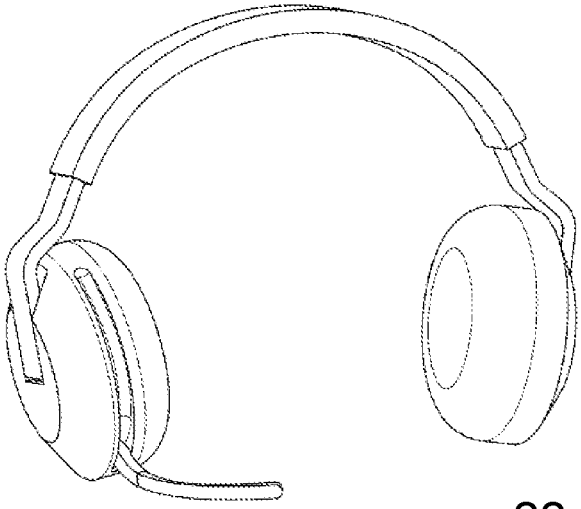
FIG. 3 is a perspective view of the headset with the microphone arm in a use position.

FIGS. 1-11 disclose a first embodiment of a headset 1 according to the invention. The headset 1 comprises a first earphone 2, a second earphone 3 and a headband 7 connecting the first and the second earphones 2, 3. A user 16 wearing the headset will have the first earphone 2 around his right ear and the second earphone 3 around his left ear. The first and second earphones 2, 3 comprise and earphone housing 27. An inner side 11 of the right earphone housing 27 faces the side of the user's head, while an outer side 12 of the earphone housing 27 faces away from the user's head. Ear earphone 2, 3 has a ring-shaped ear cushion 30, that encircles the ear of the user and creates a front chamber. A circumferential wall 10 extends 360 degrees around the earphone 2 between the inner side 11 and the outer side 12. The right earphone 2 comprises a microphone arm 4, which is rotatably attached to the earphone housing by means of a first hinge 14 with a first hinge axis 8. The microphone arm 4 can rotate about this from a rest position shown in FIGS. 1, 5 and 6 to an intermediate position shown in FIGS. 2, 7 and 8. In the rest position, the microphone arm 4 is received in a recess 19 in the circumferential wall 10. As it can be seen in FIG. 6, only a free end 17 of the microphone arm 4 is sticking out from the recess 19 in the rest position, whereby the user can grab the microphone arm 4 and rotate it out to the intermediate position. The microphone arm 4 is by means of a second hinge 15 with a second hinge axis 9 divided into a first arm part 5 and a second arm part 6. The first arm part 5 extends between the first and second hinges 14, 15, and the second arm part 6 extends between the second hinge 15 and the free end 17. One or more microphones are arranged at the free end 17. The first hinge axis 8 extends essentially perpendicular to the side of the user's head. The second hinge axis 9 extends perpendicular to the first hinge axis 8 and essentially in the longitudinal direction of the microphone arm 4. The circumferential wall 10 extends around a somewhat oval shape. In the rest position, the outer surface 29 of the microphone arm 4 has curvature corresponding the curvature of the circumferential wall, whereby it flushes with the circumferential wall 10. From the intermediate position shown in FIGS. 2, 7 and 8, the user can grab the second arm part 6 and rotate it approximately 90 degrees around the second hinge axis 9 into a use position shown in FIGS. 3, 9, 10 and 11, where the free end 17 is rotated closer to the user's mouth 18. Thus, the curvature of mainly the second arm part 6 is exploited to bring the microphone 13 closer to the mouth to obtain a better signal-to-noise ratio. In the shown embodiment, the first arm part is approximal 25 mm and the second arm part is approximately 75 mm. Thus, the total length of the microphone arm 4 is approximately 100 mm. The earphone is approximately 100 mm long and 75 mm wide. In the use position, the displacement 31 of the free end 17 from the intermediate and rest positions inwards in the direction of the first hinge axis 8 towards the user's head is approximately 4 cm. The first and second hinges 14, 15 have frictional movement, whereby the parts only rotates, when a user actively force them to rotate in relation to the other. Thus, the user can rotate the microphone arm 4 from the rest position to the intermediate position, and hereafter rotate the second arm part 6 in relation to the first arm part 5, where after the microphone arm 4 will stay in this position, until the user moves it back or adjusts it.

Figure 4:
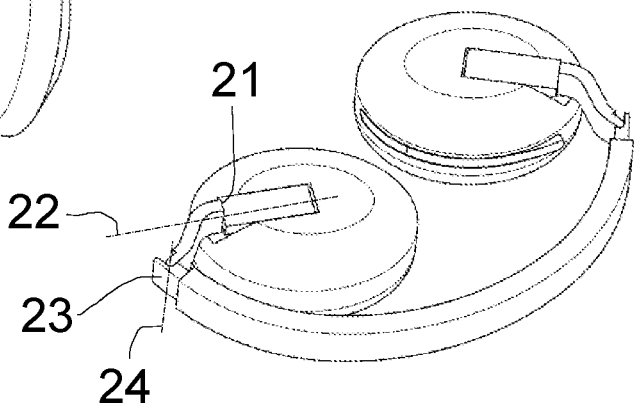
FIG. 4 is a perspective view of the headset in a collapsed state.
Figure 5:
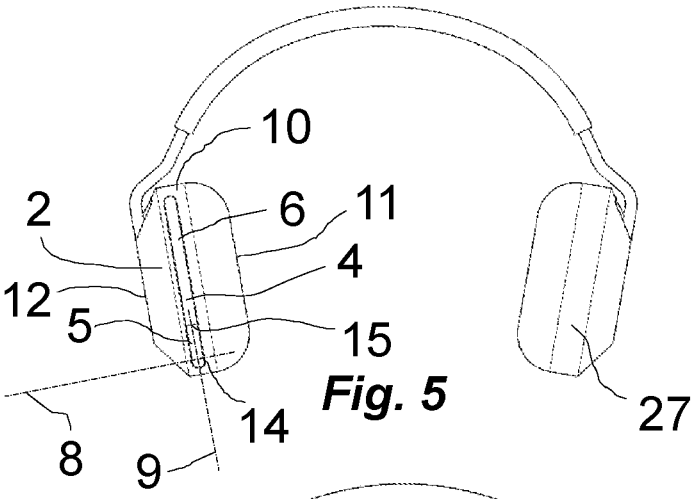
FIG. 5 is a front view of the headset according to the first embodiment of the invention with the microphone arm in the rest position.
Figure 6:
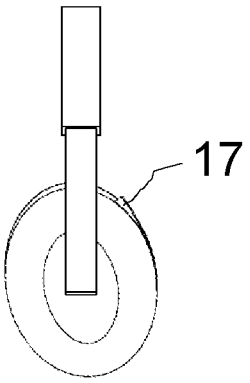
FIG. 6 is a side view of the headset with the microphone arm in the rest position.
Figure 7:
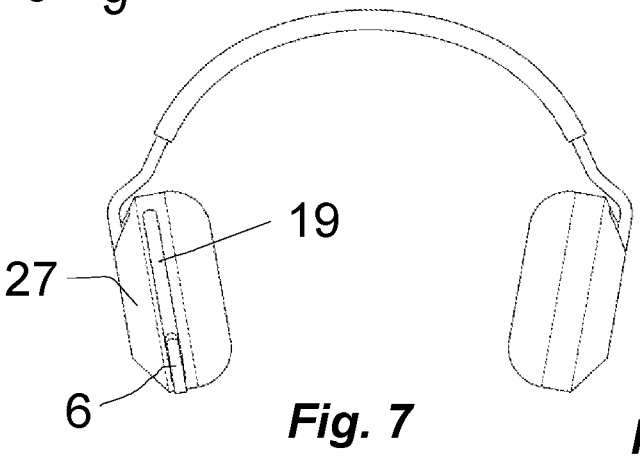
FIG. 7 is a front view of the headset with the microphone arm in the intermediate position.
Figure 8:
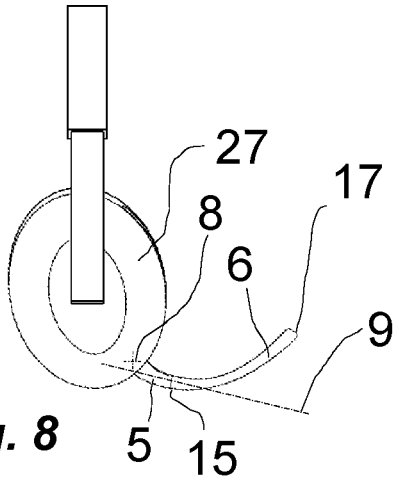
FIG. 8 is a side view of the headset with the microphone arm in the intermediate position.
Figure 9:
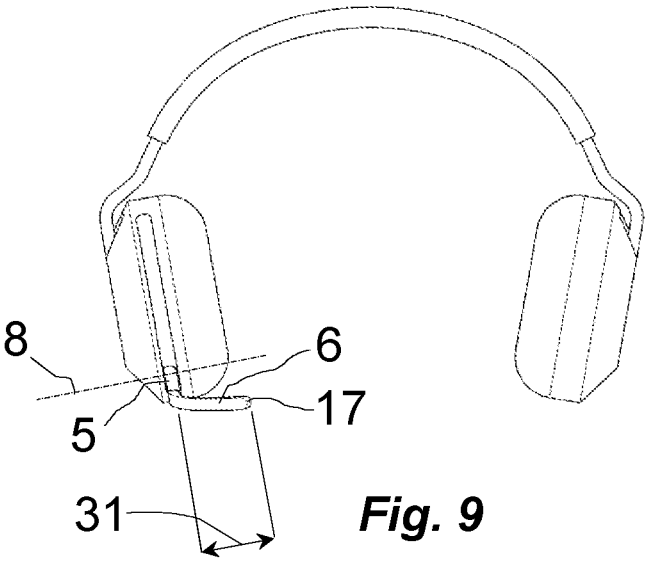
FIG. 9 is a front view of the headset with the microphone arm in the use position.
Figure 10:
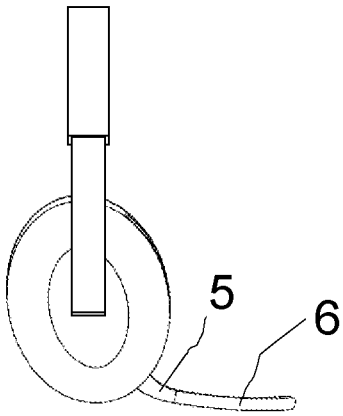
FIG. 10 is a side view of the headset with the microphone arm in the use position.

FIG. 4 shows the headset 1 in a collapsed and compact position where it is suitable for transport. Each earphone 2, 3 is connected to the headband 7 by means of three hinges. Only two of them are relevant for the collapsible state shown in FIG. 7. A first earphone hinge 21 has a first earphone hinge axis 22, and a second earphone hinge 23 has a second earphone hinge axis 24, which is perpendicular to the first earphone hinge axis 22.

Figure 11:
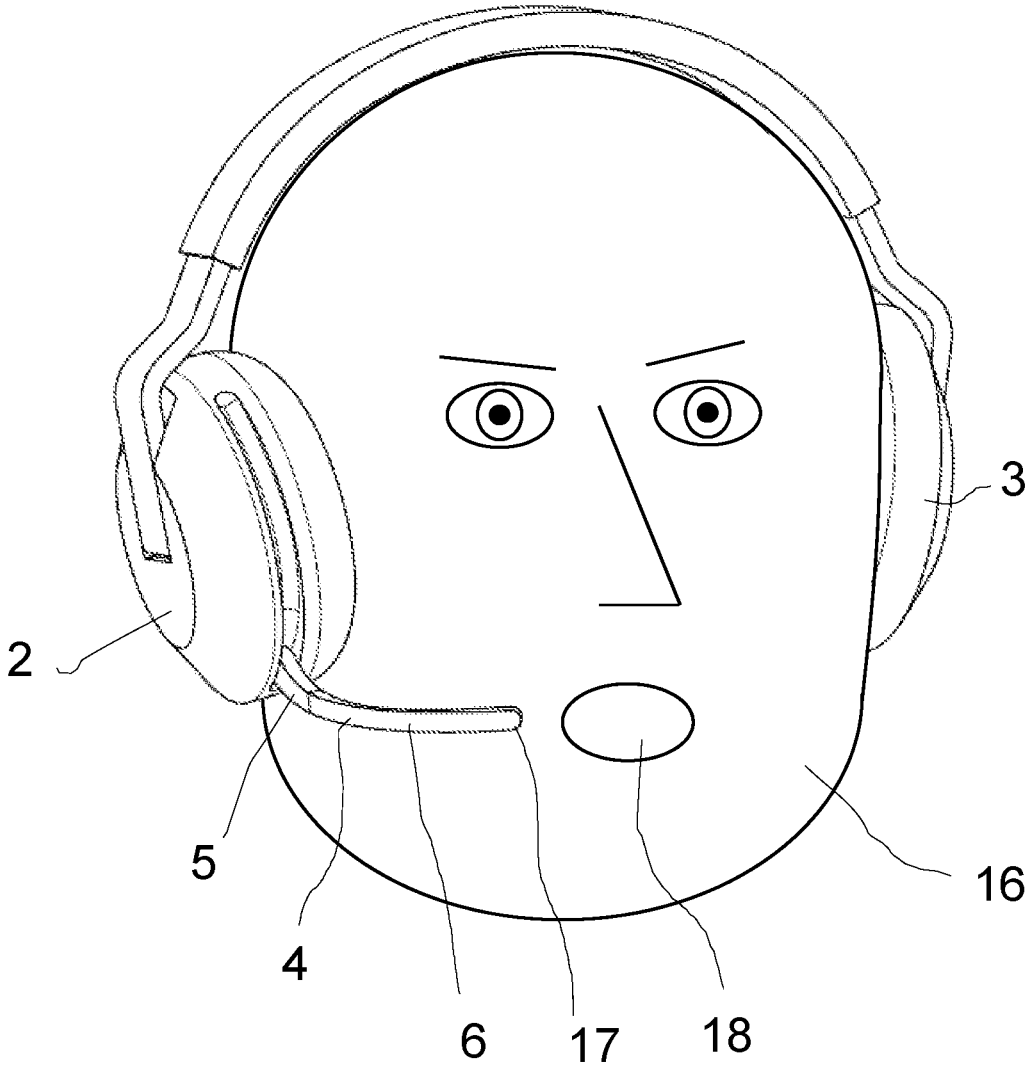
FIG. 11 is a perspective view of the headset according to the first embodiment arranged on a user.
Figure 12:
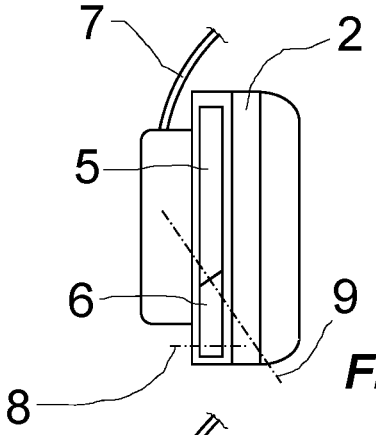
FIG. 12 is a front view of a headset according to a second embodiment with a microphone arm in a rest position.
Figure 13:
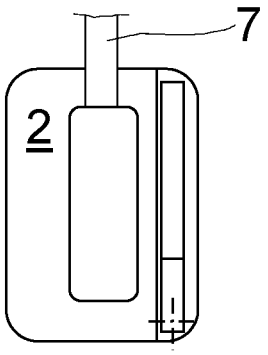
FIG. 13 is a side view of the headset with the microphone arm in the rest position.
Figure 14:
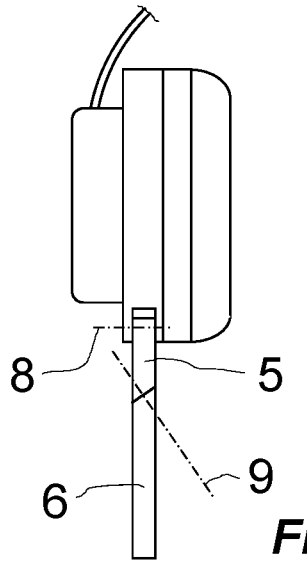
FIG. 14 is a front view of the headset with the microphone arm in an intermediate position.
Figure 15:
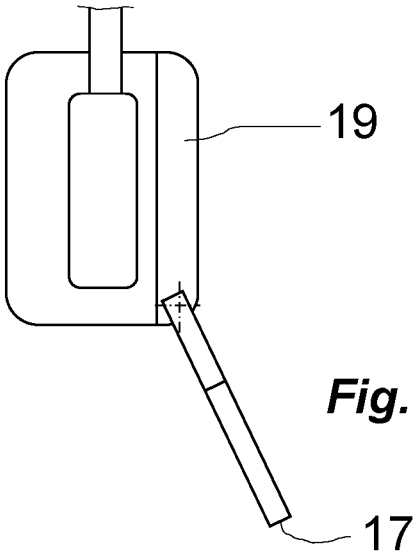
FIG. 15 is a side view of the headset with the microphone arm in the intermediate position.
Figure 16:
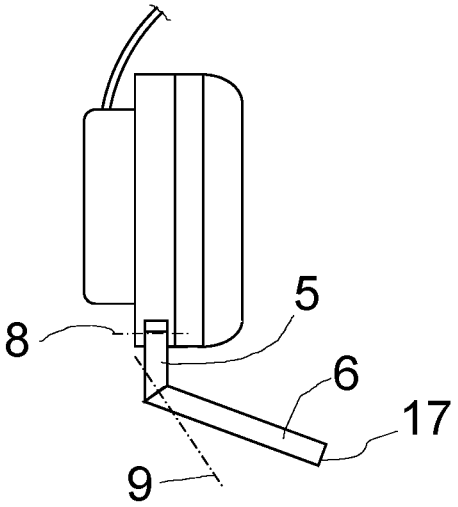
FIG. 16 is a front view of the headset with the microphone arm in a use position.
Figure 17:
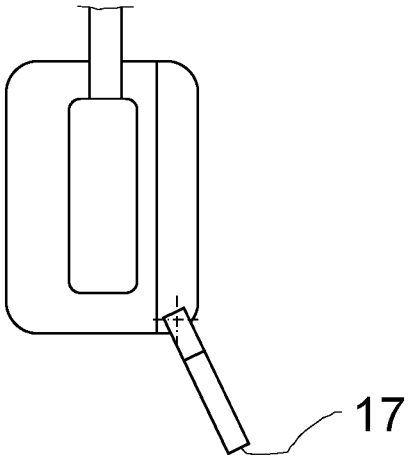
FIG. 17 is a side view of the headset with the microphone arm in the use position.

FIG. 11 shows the headset 1 when worn by a user 16 with the microphone arm 4 in the use position. It is clear that the free end 17 of the microphone arm 4 is located closed the mouth 18 of the user 16, whereby an efficient voice pick-up can be obtained.

FIGS. 12-17 show parts of a headset according to a second embodiment of the invention. In this embodiment, the left earphone 2 has a rectangular shape with rounded corners. The microphone arm 4 differs from the microphone arm according to the first embodiment by being straight in the rest and intermediate positions. The angle between the first hinge axis 8 and the second hinge axis 9 is about 35 degrees. Due to this angle, the second arm part 6 does not have to be curved in order to arrange the free end 17 closer to the mouth of the ser. Also, the recess 19 for receiving the microphone arm 4 in the rest position differs from the first embodiment. Here, there recess is more "open" by having two inner walls, that are arranged to provide an angle of approximately 90 degrees. Thus, the microphone arm 4 is more visible and easier to grab in the rest position than in the first embodiment.

Figure 18:
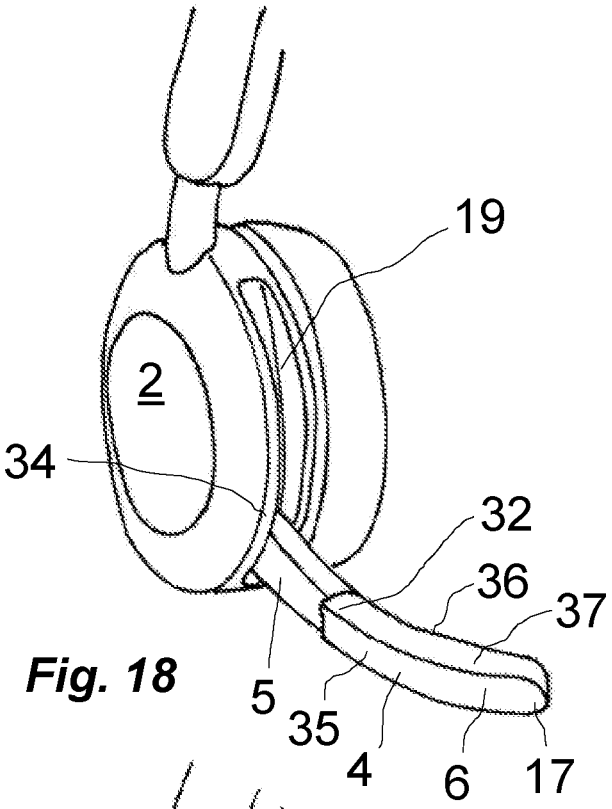
FIG. 18 is a perspective of a headset according to a third embodiment, where the microphone arm is in a use position.

FIGS. 18-22 show a third embodiment, which is very similar to the first embodiment shown in FIGS. 1-11 but is having means for easier moving the microphone arm 4 from the use position to the rest position. The second arm part 4 has a front face 35, a rear face 36, a first side face 37 and a second side face 38. In FIG. 18, the microphone arm 4 is in a use position. The first arm part 5 is rotated about the first hinge axis to extend away from the earphone 2. The second arm part 4 is rotated approximately 90 degrees about the second hinge axis from a first position to a second position to bring the free end 17 of the microphone arm 4 closer to the user's mouth when the headset is worn. In cross-section, the second arm part 6 is larger in one direction than the first arm part 5. Thus, a first side face part 32 of the first side face 37 extends outside the corresponding wall part of the first arm part. When the user wants to put the microphone arm 4 into the rest position in the recess 19, he pushes the first arm part 5 in the direction of the recess 19. When the microphone arm 4 reaches the intermediate position shown in FIG. 19, the first side face part 32 will engage an edge part 34 of the recess 19. When the user pushes further, the second arm part 6 will be forced to rotate about the second hinge axis 9 due to the engagement between the first side face part 32 and the edge part 34. When the first arm part 5 and the whole microphone arm 4 has reached the rest position shown in FIG. 20, the second arm part 6 has been pushed the approximately 90 degrees back to the first position.

Figure 20:
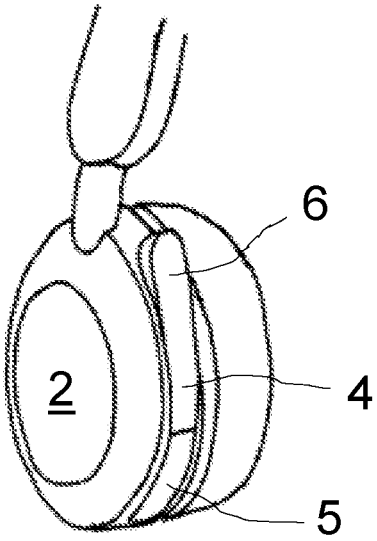
FIG. 20 is a perspective view of the third embodiment, where the microphone arm is in a rest position.
Figure 21:
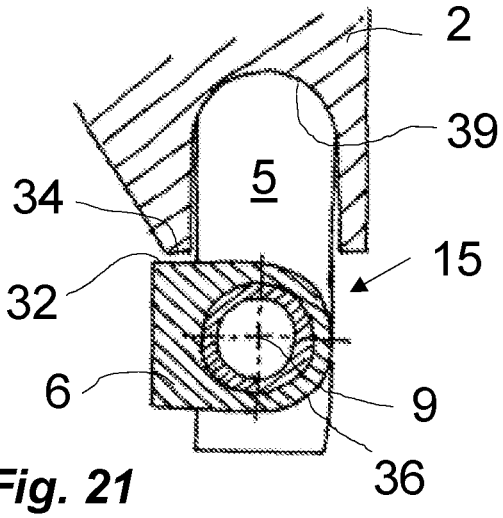
FIG. 21 is a cross-sectional view through the third embodiment with the microphone arm in the intermediate position shown in FIG. 19.
Figure 19:
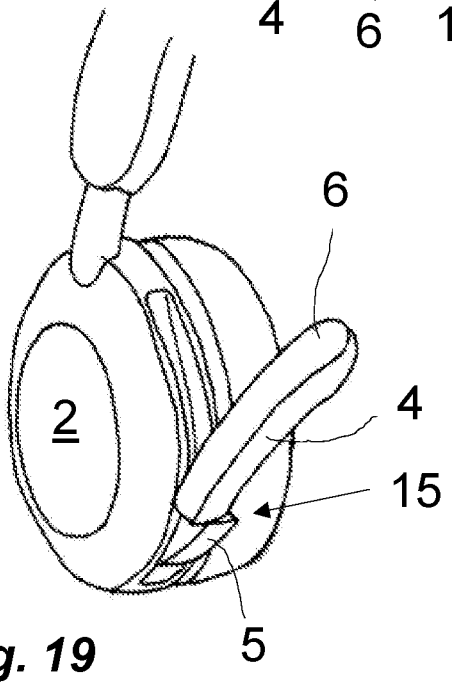
FIG. 19 is a perspective view of the third embodiment, where the microphone arm is in an intermediate position.
Figure 22:
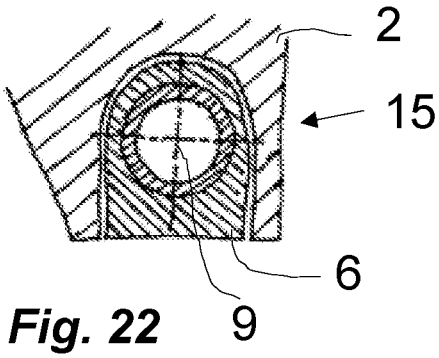
FIG. 22 is a cross-sectional view through the third embodiment in the rest position shown in FIG. 20.
Figure 23:
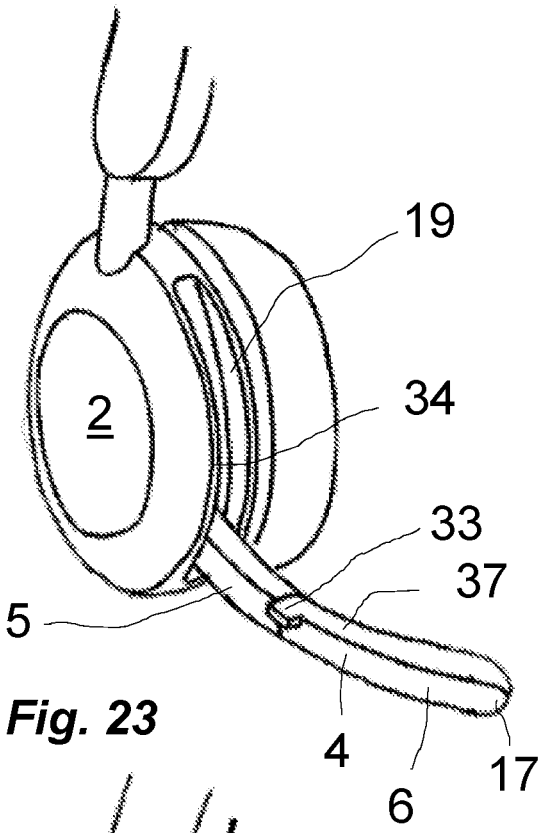
FIG. 23 is a perspective of a headset according to a fourth embodiment, where the microphone arm is in a use position.
Figure 25:
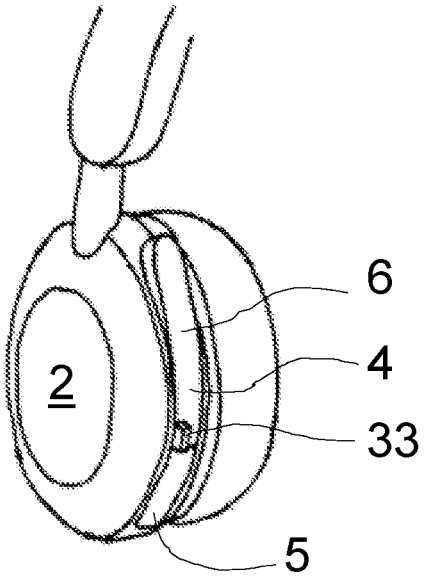
FIG. 25 is a perspective view of the fourth embodiment, where the microphone arm is in a rest position.
Figure 26:
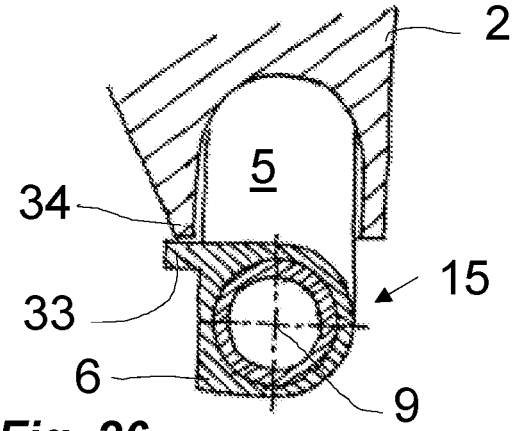
FIG. 26 is a cross-sectional view through the fourth embodiment with the microphone arm in the intermediate position shown in FIG. 24.
Figure 24:
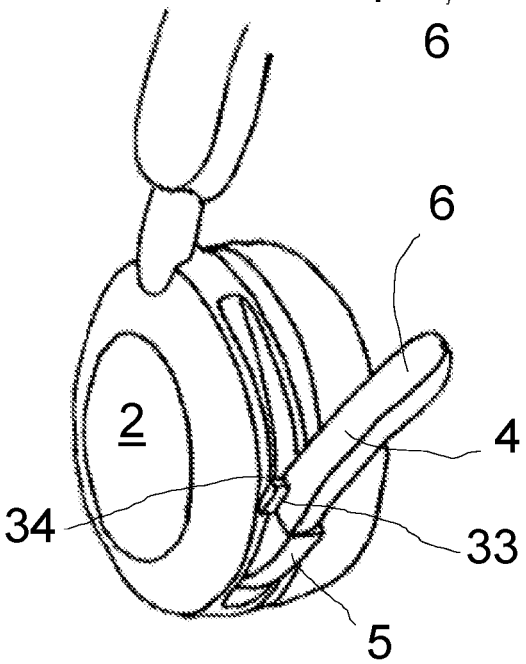
FIG. 24 is a perspective view of the fourth embodiment, where the microphone arm is in an intermediate position.
Figure 27:
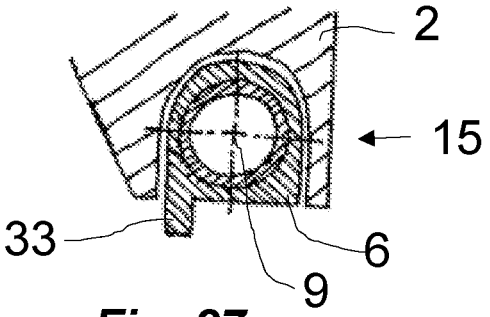
FIG. 27 is a cross-sectional view through the fourth embodiment with the microphone arm in the rest position shown in FIG. 20.

FIG. 21 is a cross-sectional view through the second hinge 15, the second arm part 6 and the earphone 2, when the microphone arm 4 is in the intermediate position shown in FIG. 19. The first sidewall part 32 of the second arm part 6 is just going to engage the edge part 34 of the recess 19. In FIG. 22 the microphone arm 4 has been rotated into the rest position, and the second arm part 6 has been rotated about the second hinge axis 9 completely from the second position to the first position. As seen in FIGS. 21 and 22, the rear side face 36 and recess bottom 39 are rounded. Thus, the second arm part 6 can rotate freely during rotation from the second position to the first position and rest against the recess bottom 39. In the rest position a large part of the front face 35 is flush with earphone around the recess 19. As seen in FIG. 20, the free end 17 of the microphone arm 4 protrudes from the recess 19 in the rest position, so that the user can access the microphone arm 4, when he wants to move it to the use position.

FIGS. 23-27 disclose a fourth embodiment which is very similar to the third embodiment shown in FIGS. 18-22, and only the differences will be explained here in detail. Instead of letting the second arm part 6 having a larger cross section than the first arm part 5, the second arm part 6 is provided with a protrusion 33. The protrusion 33 is a small extension of the first side face 37. The protrusion 33 engages the edge part 34 of the recess 19, when the microphone arm 4 is rotated about the first hinge axis from the intermediate position shown in FIG. 24 to the rest position shown in FIG. 25. The protrusion 33 protrudes from the earphone 2, when the microphone arm 4 is in the rest position. On the other hand, the recess 19 is shallower than the recess 19 in the third embodiment, whereby it does not take up so much space in the earphone 2.

The invention is not limited to the embodiments shown here. There could be provided a linkage between the first and second hinges 14,15, whereby the second arm part automatically rotates inwards, when the first arm part 4 is rotated out from the rest position. Thus, the microphone arm 4 is moved directly from the rest position to the use position and vice versa. The microphone arm 4 can be provided with more than one microphone at the free end 17. Thus, there could be f. ex. two microphones or two microphone openings at the free end. There could also be provided more microphones or microphone openings at one or more distances from the free end 17. The headset can be a monaural headset with only one earphone. The headset can be corded or wireless.

The headsets according to the first and second embodiments are so-called over-the-ear headsets, where the ear cushion encircles the ear and rests against the skull. However, the invention also relates to so-called on-the-ear headsets where the ear cushion rests against the ear.

Also, the headset can be corded or wireless.

REFERENCE SIGNS

1 Headset
2 First earphone
3 Second earphone
4 Microphone arm
5 First arm part
6 Second arm part
7 Headband
8 First hinge axis
9 Second hinge axis
10 Circumferential wall
11 Inner side of earphone
12 Outer side of earphone
13 Microphone
14 First hinge
15 Second hinge
16 User
17 Free end of microphone arm
18 Mouth
19 Recess
20 Ear cushion
21 First earphone hinge
22 First earphone hinge axis
23 Second earphone hinge
24 Second earphone hinge axis
25 Headband hinge
26 Headband hinge axis
27 Earphone housing
28 First part of circumferential wall
29 Outer surface of microphone arm
30 Front chamber
31 Displacement of free end of microphone arm
32 First side face part
33 Protrusion
34 Edge part of recess
35 Front face of second arm part
36 Rear face of second arm part
37 First side face of second arm part
38 Second side face of second arm part
39 Recess bottom

The invention claimed is:

1. A headset comprising a first earphone with an inner side facing the user's head, when the headset is worn, and an outer side facing the opposite direction of the inner side, and a circumferential wall located between the inner side and the outer side, and wherein the headset comprises a microphone arm, which is attached to the earphone to be rotatable around a first hinge axis of a first hinge, so it can rotate between a use position, where it extends away from the earphone housing, and a rest position, where it follows a first part of the circumferential wall, wherein the first earphone has a recess for receiving the microphone arm in the rest position, wherein the microphone arm comprises a first arm part extending from the first hinge and a second arm part extending between the first arm part and a free end, and wherein the first arm part and the second arm part are interconnected by a second hinge with a second hinge axis, whereby the first arm part, the second arm part and the second hinge are adapted, so that the free end of the microphone arm can be brought closer to the mouth of the user by rotating the second arm part about the second hinge axis from a first position to a second position, and wherein the second arm part comprises an engagement part, which during rotation of the microphone arm around the first axis from the use position to the rest position is adapted to engage the earphone, whereby the second arm part is forced to rotate from the second position to the first position.

2. A headset according to claim 1, wherein the engagement part is adapted to engage an edge part of the recess during rotation of the microphone arm from the use position to the rest position.

3. A headset according to claim 2, wherein the engagement part is embodied as a protrusion in the vicinity of the second hinge.

4. A headset according to claim 2, wherein the engagement part is provided by a first side face part of the first side face.

5. A headset according to claim 1, wherein the microphone arm is curved.

6. A headset according to claim 5, wherein an essential portion the second arm part has an outer surface with a curvature corresponding to a curvature of the first part of the circumferential wall.

7. A headset according to claim 1, wherein the second arm part is longer than the first arm part.

8. A headset according to claim 7, wherein the second arm part is at least two times, preferably at least three times as long as the first arm part.

9. A headset according to claim 1, wherein the first hinge is located at the lower end of the earphone, wherein the lower end is defined as the end closest to the user's mouth when the headset is worn.

10. A headset according to claim 1, wherein the second hinge axis is essentially perpendicular to the first hinge axis.

* * * * *